US005092148A

United States Patent [19]

Rong-Long

[11] Patent Number: 5,092,148

[45] Date of Patent: Mar. 3, 1992

[54] PRY-PROOF COMPUTERIZED MECHANICAL LOCK

[76] Inventor: Wang Rong-Long, No. 1, Lane 108, Hu-lin street, Taipei, Taiwan

[21] Appl. No.: 564,442

[22] Filed: Aug. 8, 1990

[51] Int. Cl.[5] ..... E05B 49/02

[52] U.S. Cl. ..... 70/278; 70/386; 235/382; 340/825.31

[58] Field of Search ..... 70/278, 277, DIG. 49, 70/DIG. 46, 386; 340/825.3, 825.31; 235/382

[56] References Cited

U.S. PATENT DOCUMENTS 4,205,542 6/1980 Renda ..... 70/DIG. 49 X
4,924,686 5/1990 Vonlanthen ..... 70/278 X

FOREIGN PATENT DOCUMENTS 2159568 12/1985 United Kingdom ..... 70/278
2178476 2/1987 United Kingdom ..... 70/278

*Primary Examiner*—Lloyd A. Gall
*Attorney, Agent, or Firm*—Dvorak and Traub

[57] ABSTRACT

A kind of pry-proof computerized mechanical lock which is an integrated lock structure of mechanism and circuit. The front half inside the lock has several plates. The rear half of the lock has a rotor and a fixed seat which supports conductive bars in a special line-up. These conductive bars are biased by respective springs. The rear half of the key is aligned with several plates inside the lock which have portions engageable with openings in the key. When teh key is inserted, it matches accurately the plates through these opening and holes. When the key is turned, the rotor is made to turn at the same time to make the specially-shaped conductive plates to come into contact with the conductive bars. The circuit is then conductive to drive the electromagnetic bolt for opening a door.

5 Claims, 3 Drawing Sheets

PRY-PROOF COMPUTERIZED MECHANICAL LOCK

BACKGROUND OF THE INVENTION

This invention relates to a type of "PRY-proof computerized mechanical lock", comprising mainly a key, lock unit, conductive bars, control circuit board, storage battery and an electromagnetic door bolt. It is an integration of a mechanical device and an electric circuit, by means of correct combination of several openings and holes in the key and several plates and a cylindrical object inside the lock to enable the key to rotate in a specific direction and in coordination with the rear part of the key to serve as a support for the key and also as a rotating object with a positioning function to produce rotation in the key. When rotated to a particular angle, several special-shaped conductive plates in the key's front half part will be in contact with the conductive bars which line up specially on a fixing seat, and subjected to spring resiliency, enable the preset circuit to become conductive, so the control circuit may energize the electromagnetic door bolt to open the door. When a first circuit, which is in connection with a further circuit, is damage or when the lock body is damage, another set of similar circuits may be and by way of several sets of wiring to conduct power and drive the electro-magnetic door bolt to open the door. This invention has AC/DC switching circuit. When in normal use, the storage battery remains in a recharging status, and during a power failure or if the outer line is cut by a burglar, it will convert to battery power supply for continuous use.

A conventional mechanical lock, despite the complexity of its structure, is easily opened by a burglar. If it cannot be opened, it can easily be damage in order to open the door. Therefore, its burglar-proof performance is not too good. The ordinary computer lock is an electronic lock with push buttons to input the code, thus it can easily have poor a contact and so fail. Also one must remember the code to open it. If the code is forgotten or in the case of other trouble, it cannot be opened.

SUMMARY OF THE INVENTION

This invention relates to a "Pry-proof computerized mechanical lock", particularly to one featuring the combination of mechanical device and circuit, so that the key coordinates with the mechanical parts of the lock and rotates with the rotating object at the rear part at the same time. When turned to a particular angle, the key, by way of contact of several preset shaped conductive plates in the front half with conductive bars with specially line up and are subjected to spring resiliency, enables the conductivity of a preset circuit so as to drive the independent electromagnetic door bolt to open the door. The lock is mainly comprised of a key, lock body, main control unit and electromagnetic door bolt; in which in the key's rear part and the lock body's front half, there are a number of plates and a cylinder which are opposite to each other where several openings and a hole are located, when the key is inserted into the lock. These openings and the hole may accurately match several plates and the cylinder in the lock body's front half part. In this way, the key may rotate according to a preset direction, and the front half of the key and the rotating object in the lock body's rear half may rotate at same time, when they rotate to a particular angle, the specially-shaped conductive plates at the front half of the key come into contact with the conductive bars which specially line up on the fixed seat and are subject to spring resiliency. The contact makes the preset circuit produce conductivity to drive the independent electromagnetic bolt for opening of the door. This invention uses two units of the same control circuits. If the control circuit, which matches the lock body is damaged, the circuit can be made conductive by way of wiring according to setting of the circuit, thus driving the electromagnetic bolt to open the door. This invention has AC/DC switching circuit. When it is used, the battery is kept in a state of recharging. When there is a power failure or the wire for power supply is cut off, it will be automatically switched to the battery for continuous use.

DESCRIPTION OF THE DRAWING

FIG. 2-1 shows the structure in detail of this invention.

FIG. 2-2 shows how the key matches the plates within the lock and the cylinder.

FIG. 2-3 shows the motion of the lock surface and the body of the lock.

FIG. 3 shows the appearance in perspective view.

DESCRIPTION OF SPECIFIC EMBODIMENT

Figure 1:
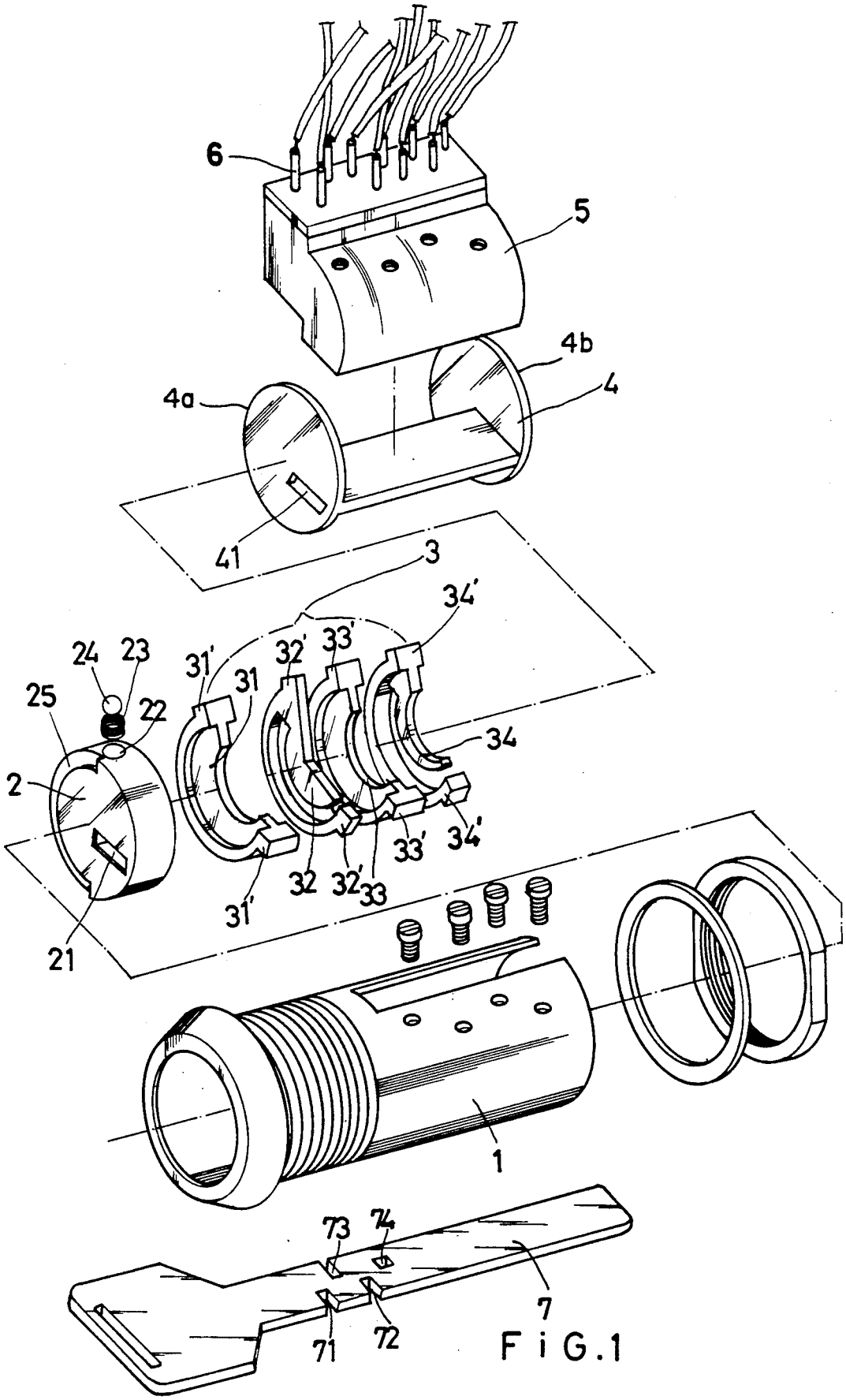
FIG. 1 shows an exploded view of the invention.
Figure 3:
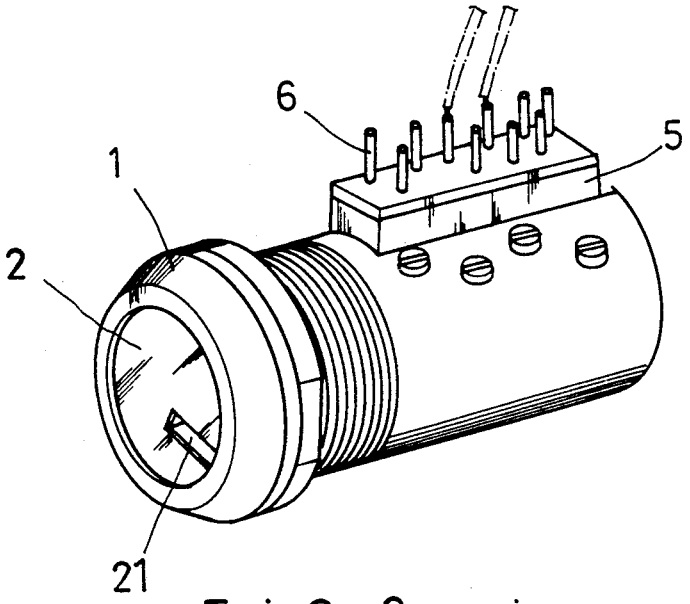
Figure 2:
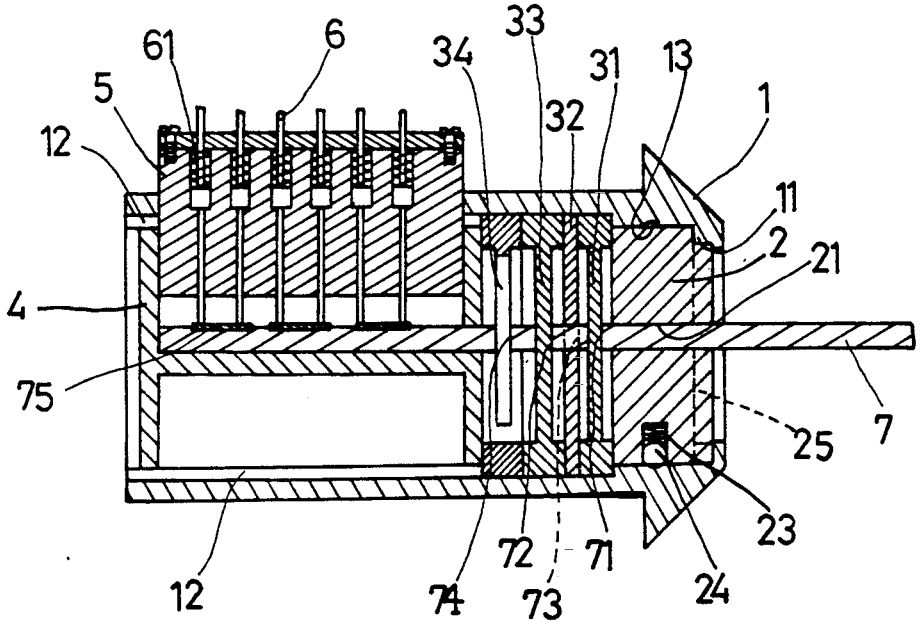
FIG. 2 shows a cross section of this invention.
Figure 2:
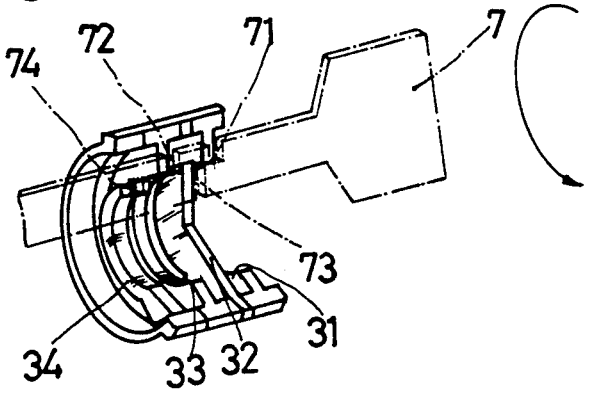
Figure 4:
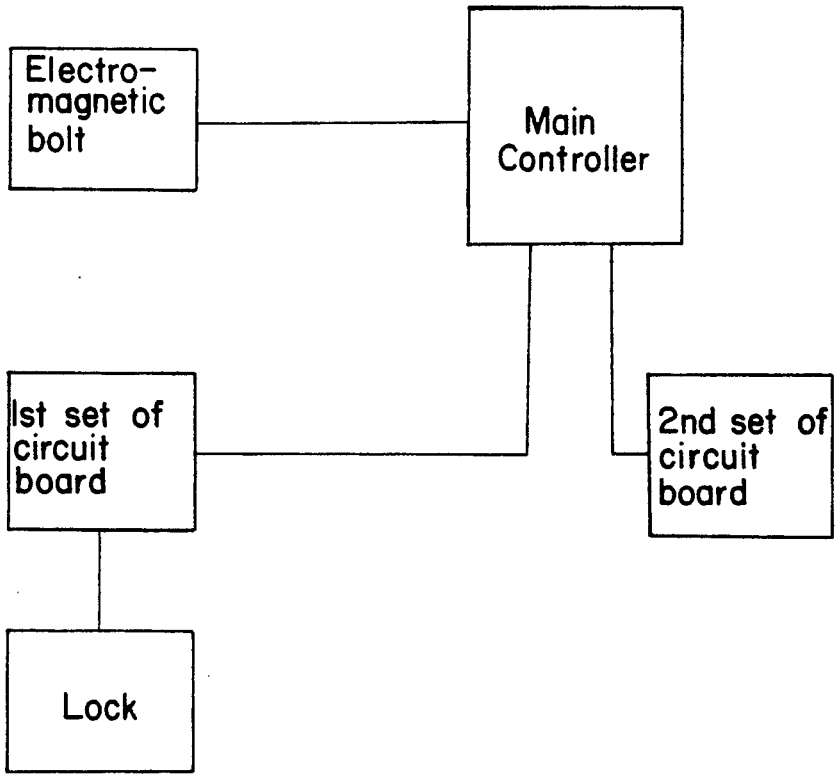
FIG. 4 shows various units of this invention.
Figures 2, 3:
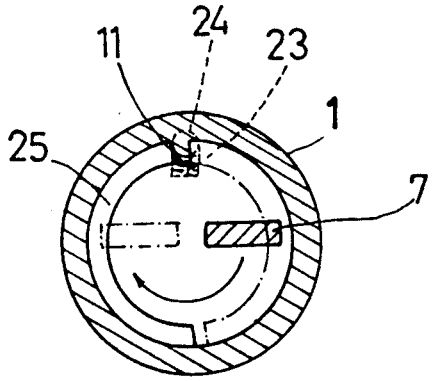
Figures 1, 2:
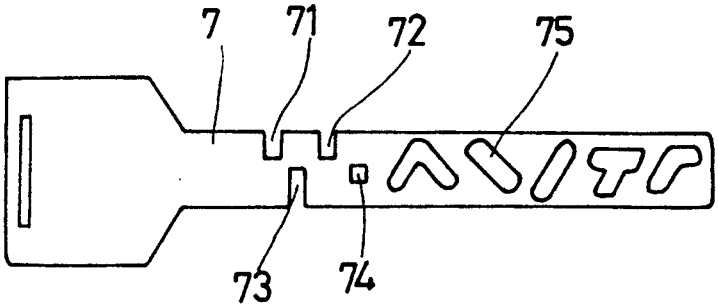

Please first refer to FIGS. 1, 2 and 3. A tubular lock (1) has a slot (21) in a front part inside, a lock part (2) of a rotating angle control slot (25). When both the ends of rotating angle control slot (25) rotate with respect to a block (11) in the proper place in the front part within the lock (1), the rotating angle of a key (7) is thus controlled. There is a ball hole (22) in the lock part (2) and containing spring (23) and a steel ball (24). When the steel ball is affected by the spring resiliency, and when the key (7) makes the lock part 2 to rotate to its original place, the top of the steel ball (24) will engage with a hole (13) in the internal wall surface of the lock (1). The lock (1) has a set of rounded plates (3) which set comprises two plates (31) and (33), a plate (32) and a plate (34). The plates have their respective portions (31'), (32'), (33') and (34') to engage a groove (12) within the lock (1) to achieve a locked positioning. A rotor (4), which has end walls (**4*a*) and (4*b*) and a slot (41) in the end wall (4*a*), is installed behind the set of plates (3) in the rear of the lock (1). Between the end walls (4*a*) and (4*b*) of the rotor (4), there is installed a fixed seat (5) which is firmly attached to the lock (1) by a screw. When the key (7) is inserted into the slot (21) of the lock (1), the openings (71), (72), (73) and a hole (74) in the key (7) will accurately match the set of plates (3), as shown in FIG. 2—2, whereby the key (7), the lock part (2) and the rotor (4) will rotate in unison. When the key (7) is rotated to a preset angle, the conductive portions (75) in appropriate shapes disposed on one side of a front half of the key (7), as shown in FIG. 2-1, come into contact with the conductive bars (6) which are installed in the fixed seat (5) and which are resiliently supported by springs (61). Lower ends of the bars (6) established contact with appropriate conductive portions (75) on the key (7). Upper ends of the conductive bars (6) are connected to appropriate circuits as shown in block diagram in FIG. 4** to actuate a main controller to drive an electromagnetic bolt for opening a door.

In summary, this invention enables mechanical parts and circuits to be integrated into one body and uses two circuits in order that one of the circuits may open the door when there is any breakdown or damage.

I claim:

1. A pick-proof computerized mechanical lock comprising an elongated tubular body provided with a flanged head mountable against a surface of a hole in a door, a cylindrical lock part rotatably mounted in said body and adjacent to said flanged head, a semi-circular slot defined in a frontal surface of the lock part, a key slot in said frontal surface, a resiliently mounted steel ball supported in a peripheral wall of said lock part, a recess in an inner wall of said flanged head for securing said steel ball, a set of plates positioned in said tubular body adjacent said lock part, a rotor disposed in said tubular body abutting said set of plates, an enlongated fixed seat resiliently supporting in line a number of spaced conductive bars, said fixed seat being mounted abutting one end of said rotor, said set of plates defining a key slot, and an elongated key insertable through said key slots and having a mid-portion provided with apertures alignable with engaging portions on said set of plates and a number of conductive portions adjacent an inner end of said key, and alignable with said conductive bars.

2. A lock according to claim 1, wherein said rotor comprises a pair of spaced circular walls, a flat spacing bar fixedly supporting said circular walls, one longitudinal edge of said bar being flush with said circular walls, a key slot in one of said circular walls being aligned with a surface of said flat spacing bar to permit slidable entry of said key along said surface.

3. a lock according to claim 1, wherein said plates have different shapes.

4. A lock according to claim 1, wherein said appertures have different shapes aligning with corresponding shapes on said engaging portions.

5. A lock according to claim 1, wherein said conductive portions have shapes for aligning with the corresponding arrangement of said conductive bars.

* * * * *